US010763560B2

(12) United States Patent
Ding

(10) Patent No.: US 10,763,560 B2
(45) Date of Patent: Sep. 1, 2020

(54) WIPER SUPPORT DEVICE FOR A PHASE SHIFTER COMPRISING A WIPER SUPPORT RESILIENTLY COMPRESSED BETWEEN A SUBSTRATE AND A COVER

(71) Applicant: CommScope Technologies LLC, Hickory, NC (US)

(72) Inventor: Guomin Ding, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/251,893

(22) Filed: Jan. 18, 2019

(65) Prior Publication Data

US 2019/0237836 A1 Aug. 1, 2019

(51) Int. Cl.
*H01P 1/18* (2006.01)
*H01Q 3/32* (2006.01)

(52) U.S. Cl.
CPC ..... *H01P 1/184* (2013.01); *H01Q 3/32* (2013.01)

(58) Field of Classification Search
CPC ..... H01P 1/184; H01P 1/18
USPC ..... 333/161, 156
See application file for complete search history.

(56) References Cited

U.S. PATENT DOCUMENTS 8,344,827 B2 * 1/2013 Kim et al. ..... H01P 1/184 333/156
2006/0077098 A1 * 4/2006 Zimmerman ..... H01Q 3/32 342/372
2011/0063049 A1 * 3/2011 Bradley et al. ..... H01P 1/184 333/161
2011/0140805 A1 * 6/2011 Liu et al. ..... H01P 1/184 333/161
2016/0301121 A1 * 10/2016 Dandlberger et al. ..... H01P 1/064

* cited by examiner

*Primary Examiner* — Benny T Lee
(74) *Attorney, Agent, or Firm* — Myers Bigel, P.A.

(57) ABSTRACT

There is provided a wiper support device for a phase shifter including a substrate. The wiper support device may comprise a cover, which is provided opposite to the substrate. The wiper support device may further comprise a wiper support, which is located between the cover and the substrate. The wiper support has a first surface facing the cover and a second surface facing the substrate. The second surface may be fixed with a wiper. The wiper support device may further comprise a resilient element, which extends from the first surface of the wiper support toward the cover and abuts against the cover. The wiper support device may further comprise a fastening mechanism, which connects the cover to the substrate. The resilient element may be compressed between the cover and the wiper support.

20 Claims, 6 Drawing Sheets

WIPER SUPPORT DEVICE FOR A PHASE SHIFTER COMPRISING A WIPER SUPPORT RESILIENTLY COMPRESSED BETWEEN A SUBSTRATE AND A COVER

RELATED APPLICATION

The present application claims priority from and the benefit of Chinese Patent Application No. 20180081467.1, filed Jan. 29, 2018, the disclosure of which is hereby incorporated herein by reference in its entirety.

FIELD OF THE INVENTION

The present disclosure generally relates to a phase shifter. More specifically, the present disclosure relates to a wiper support device for a phase shifter.

BACKGROUND OF THE INVENTION

A phase shifter is a device capable of adjusting a phase of a wave. There are wide applications in such fields as radar, missile attitude control, communication, instrument and even music. The phase shifter, which organically combines transformer phase shift technology and the digital measurement technology, presents a high-precision phase shift adjustment, an accurate and visual reading, an adjustable output voltage and current, a favorable output waveform, a reliable operation and a convenient operation, so that the phase shifter can satisfy testing and checking of such instruments as single-phase and three-phase AC power and phase with a high precision, and can also be used in a test device of a meter.

In general, the phase shifter includes a wiper that presses against a PCB (printed circuit board) and is movable relative to the PCB to change a phase. It is known that, in an existing phase shifter, one end of the wiper is fixed relative to the PCB to serve as a center of rotation and the other end is rotatable about the center of rotation, thereby enabling the wiper to rotate with respect to the PCB.

The cost of the PCB is proportional to the area of the PCB; that is, the greater the area of PCB is, the higher the cost will normally be. Thus, a smaller phase shifter presents a cost advantage over a larger phase shifter. However, for a phase shifter, the use of the above-described rotary operation principle normally results in a larger size of the phase shifter, thus causing an increase in the cost.

SUMMARY OF THE INVENTION

One object of the present disclosure is to provide a wiper support device capable of overcoming at least one drawback in the prior art.

Another object of the present disclosure is to provide a phase shifter comprising the above-described wiper support device.

According to an aspect of the present disclosure, there is provided a wiper support device for a phase shifter including a substrate. The wiper support device may comprise a cover, which is provided opposite to the substrate. The wiper support device may further comprise a wiper support, which is located between the cover and the substrate. The wiper support has a first surface facing the cover and a second surface facing the substrate. The second surface may be affixed with a wiper. The wiper support device may further comprise a resilient element, which extends from the first surface of the wiper support toward the cover and abuts against the cover. The wiper support device may further comprise a fastening mechanism, which connects the cover to the substrate. The resilient element may be compressed between the cover and the wiper support.

In one embodiment of the wiper support device, the resilient element may extend obliquely towards the cover with respect to the first surface of the wiper support and is movable relative to the cover on a surface of the cover.

In one embodiment of the wiper support device, the resilient element may be a resilient finger extending from the first surface of the wiper support toward the cover, one end of which resilient finger is fixed to the first surface of the wiper support, and the other end of which resilient finger is a free end abutting against the cover and movable on a surface of the cover relative to the cover.

In one embodiment of the wiper support device, the wiper support may be provided with a cutout, within which the resilient element is located when viewed along a direction perpendicular to the first surface such that the resilient element, when compressed, is deformable towards the cutout so as to enter into the cutout. The advantage of such configuration lies in that the space required for the deformation of the resilient element can be saved, so that the wiper support device is more compact.

In one embodiment of the wiper support device, the free end may have a flat contact surface which is remained in contact with the surface of the cover facing the wiper support, so as to form a face contact between the resilient element and the cover.

In one embodiment of the wiper support device, the free end may have a projection which remains in contact with the surface of the cover facing the wiper support, so as to form a point contact between the resilient element and the cover.

In one embodiment of the wiper support device, the wiper support may be provided with a guide pin, and the cover may be provided with a guide slot, the guide pin passing through the guide slot and being movable within the guide slot.

In one embodiment of the wiper support device, the end of the guide slot may serve as a stop to limit a movement of the guide pin.

In one embodiment of the wiper support device, the guide pin may be centrally disposed on the wiper support.

In one embodiment of the wiper support device, the cover may be connected to the substrate via the fastening mechanism such that a distance between the cover and the substrate is associated with a degree at which the resilient element is compressed.

In one embodiment of the wiper support device, the fastening mechanism may comprise an adjusting means, which is configured to adjust a distance between the cover and the substrate.

In one embodiment of the wiper support device, a PCB may be fixed on the substrate, and the wiper may abut against the PCB, wherein the wiper is completely covered by the second surface of the wiper support. In the case that the second surface of the wiper support completely covers the wiper, the pressing force on the wiper support produced due to the compression of the resilient element can be uniformly applied to the entire wiper so that the pressure between the wiper and the PCB is uniform.

In one embodiment of the wiper support device, the cover, the wiper support and the substrate may be arranged parallel to each other and remain arranged in parallel during operation of the phase shifter. In this case, the distance between the cover and the substrate always maintains uniform so that the pressure between the wiper and the PCB is uniform.

In one embodiment of the wiper support device, the wiper support device may comprise a plurality of resilient elements, which are arranged in a regular manner on the wiper support. Such resilient elements may have the same configuration, and/or may be arranged symmetrically around a center of the guide pin. In this case, it can help to maintain a uniform pressure between the wiper and the PCB.

In one embodiment of the wiper support device, the wiper support may be provided with a positioning member, and the cover may be provided with a positioning slot. When the wiper support device is assembled, the positioning member may extend into the positioning slot.

According to another aspect of the present disclosure, there is provided a phase shifter, which comprises a driving mechanism and the wiper support device as described above, wherein the driving mechanism may be configured to drive the wiper support.

In one embodiment of the phase shifter, the driving mechanism may include a pull rod and a pull rod connector fixedly connected to the pull rod, the pull rod connector being configured to drive the wiper support.

In an embodiment of the phase shifter, the driving mechanism may include a pull rod and a pull rod support, in which the pull rod support is fixed on the substrate, and the pull rod is slidably coupled to the pull rod support.

In one embodiment of the phase shifter, the phase shifter may be provided with a plurality of wiper support devices that share a cover.

According to the wiper support device of the present disclosure as well as the phase shifter comprising the wiper support device, the size of the phase shifter may be greatly reduced by using such a configuration that the wiper slides on the PCB, so as to lower cost.

BRIEF DESCRIPTION OF THE DRAWINGS

After reading the embodiments below in combination with the accompany drawings, a plurality of aspects of the present disclosure will be better understood. In the accompany drawings.

DETAILED DESCRIPTION OF THE INVENTION

Figure 1:
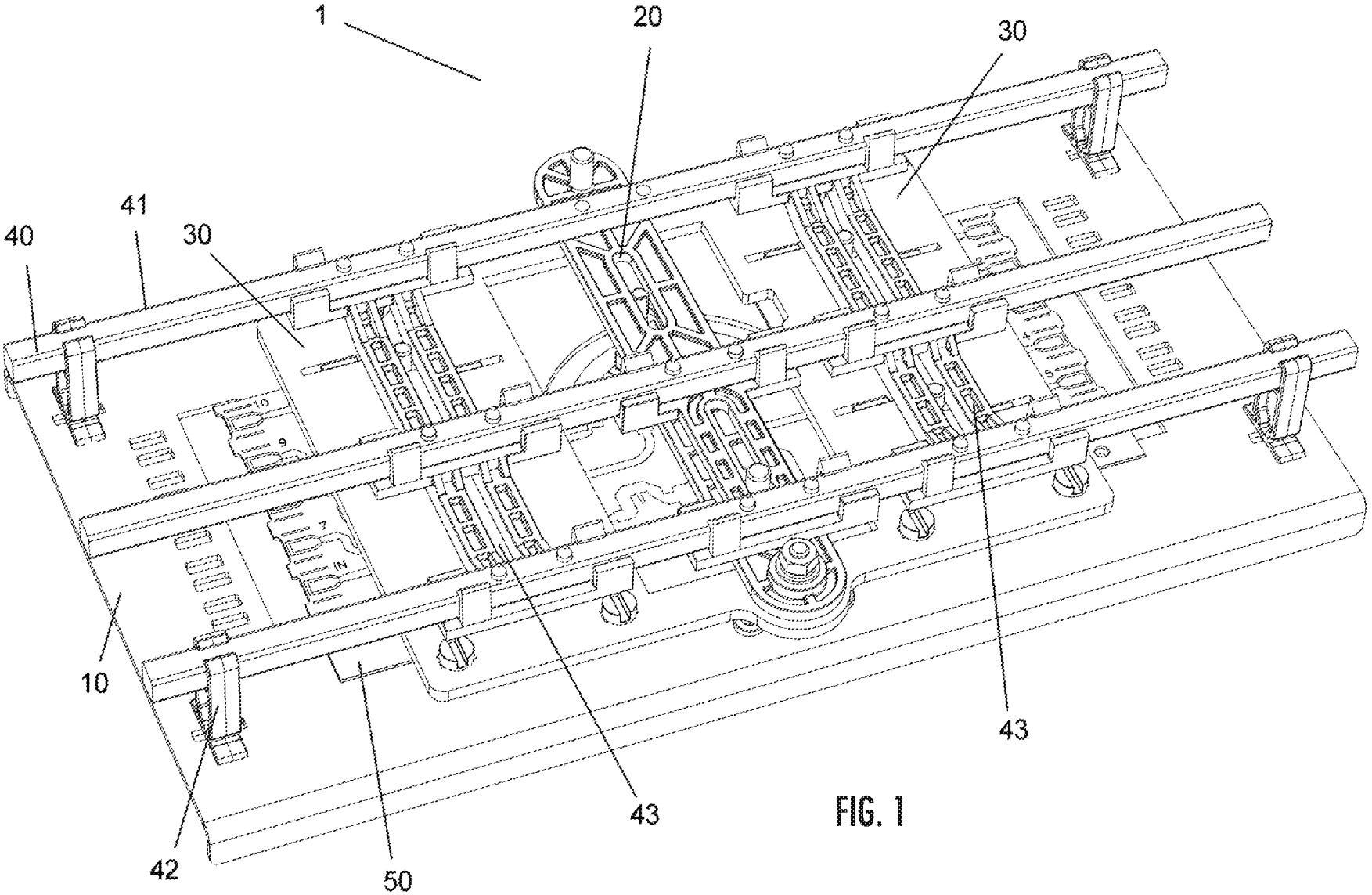
FIG. 1 is a perspective view of the phase shifter according to the present disclosure.

The present disclosure will be described as follows with reference to the accompanying drawings, in which certain embodiments of the present disclosure are shown. However, it is to be understood that the present disclosure may be embodied in many different forms and should not be construed as limited to the embodiments that are pictured and described herein. Rather, these embodiments are provided so that this disclosure will be thorough and complete, and will fully convey the scope of the invention to those skilled in the art. It will also be appreciated that the embodiments disclosed herein can be combined in any way to provide many additional embodiments.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y" As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

Referring now to the drawings, FIG. 1 shows one example of the phase shifter 1. As shown in the drawings, the phase shifter 1 comprises a substrate 10, a primary phase shifter 20, a secondary phase shifter 30, and a driving mechanism 40. In the following description, a direction along a width of the phase shifter is referred to as a transverse direction, a direction along a length of the phase shifter is referred to as a longitudinal direction, and a direction along a height of the phase shifter is referred to as a vertical direction.

The substrate 10 is a substantially plate-shaped member, and the PCB 50 is fixed on the substrate 10. The primary phase shifter 20 and the secondary phase shifter 30 are arranged above the PCB 50. The primary phase shifter 20 and the secondary phase shifter 30 may be arranged in a conventional manner. For example, as shown in FIG. 1, the primary phase shifter 20 and the secondary phase shifter 30 are arranged side by side.

The primary phase shifter 20 and the secondary phase shifter 30 each include a wiper 60 (see FIG. 2), which is configured to abut the PCB 50, and is movable with respect to the PCB 50 to thereby effect a phase change.

The driving mechanism 40 is operatively coupled with the primary phase shifter 20 and the secondary phase shifter 30, so as to drive operation of the primary phase shifter 20 and the secondary phase shifter 30. The primary phase shifter 20 and the secondary phase shifter 30 each have a wiper support device on which the wipers 60 are respectively supported. The driving mechanism 40 drives the wiper support device, thus driving movement of the wiper 60 relative to the PCB 50.

Figure 2:
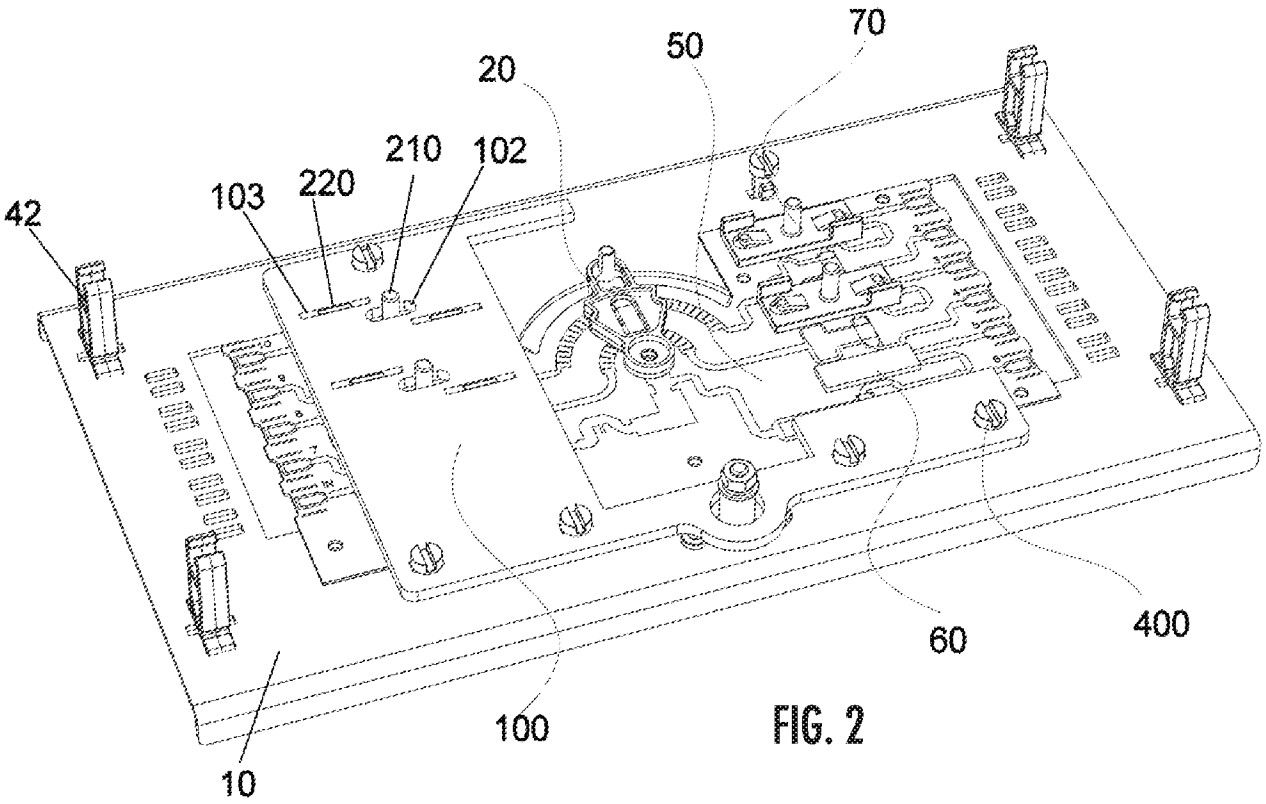
FIG. 2 is a partial perspective view of the phase shifter according to the present disclosure.

In an embodiment, the driving mechanism 40 includes a pull rod 41 and a pull rod support 42, in which the pull rod support 42 is fixed on the substrate 10, and the pull rod 41 is slidably coupled to the pull rod support 42. As shown in FIGS. 1 and 2, the pull rod 41 is arranged along a longitudinal direction and movable along the longitudinal direction.

The driving mechanism 40 further includes a pull rod connector 43 fixedly connected to the pull rod 41. As shown in FIG. 1, the pull rod connector 43 is substantially transverse to the pull rod 41, and the movement of the pull rod 41 causes movement of the pull rod connector 43. The pull rod connector 43 is operatively coupled with the primary phase shifter 20 and the secondary phase shifter 30, and more specifically, operatively coupled with the wiper support device. Accordingly, the movement of the driving mechanism 40 causes movement of the wiper support device, which in turn causes movement of the wiper 60 relative to the PCB 50.

The primary phase shifter 20 and the secondary phase shifter 30 may use the same or different configurations. In the illustrated embodiments, the primary phase shifter 20 and the secondary phase shifter 30 use different structures. However, this is not restrictive, but merely exemplary. As shown in FIGS. 1 and 2, the secondary phase shifter 30 (FIG. 1) uses a sliding configuration which comprises the wiper support device 70 (FIG. 2) according to the present disclosure. The wiper support device 70 (FIG. 2) which supports the wiper 60 (FIG. 2), is operatively coupled with the driving mechanism 40 (FIG. 1) to cause the wiper 60 (FIG. 2) to slide relative to the PCB 50 (FIG. 2). The wiper support device 70 (FIG. 2) according to the present disclosure will be described in detail below.

Figure 3:
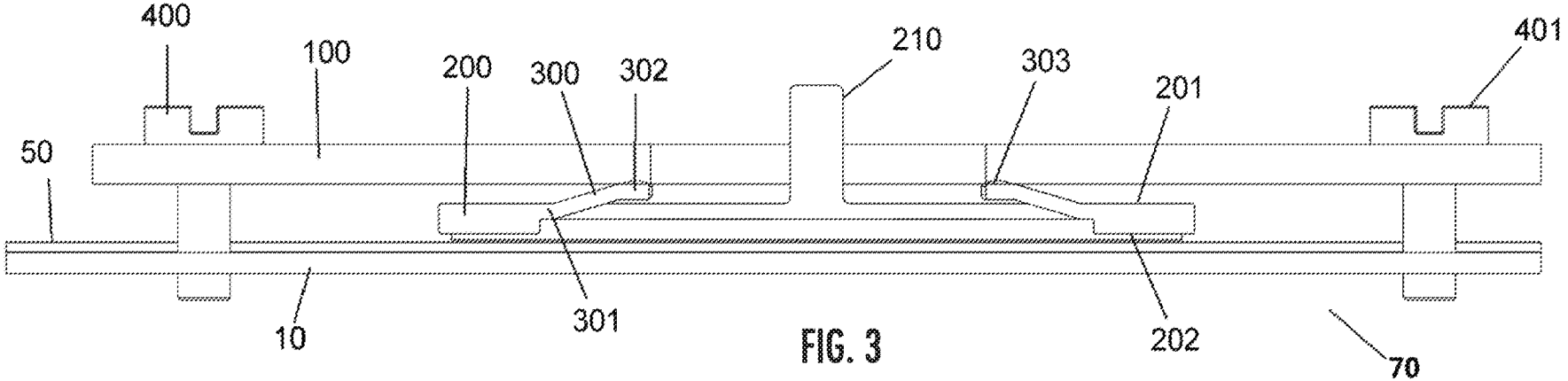
FIG. 3 is a cross-sectional view of the wiper support device according to the present disclosure.
Figure 4:
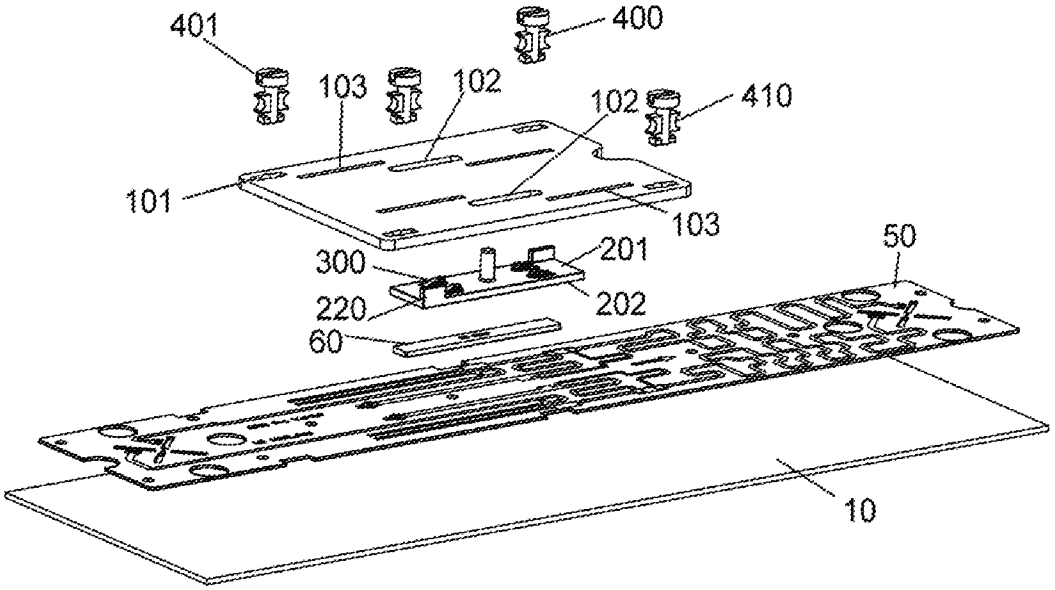
FIG. 4 is an exploded perspective view of the wiper support device according to the present disclosure.

Referring now to FIGS. 3 and 4, FIG. 3 shows one example of the wiper support device 70 (FIG. 2). As shown in the drawings, the wiper support device 70 serves to support the wiper 60 in the phase shifter such that the wiper 60 is slidable with respect to the PCB, thereby changing a phase. The wiper support device 70 includes a cover 100 (FIG. 3), a wiper support 200 (FIG. 3), a resilient element 300, and a fastening mechanism 400.

As shown in FIG. 3, the cover 100 is a substantially plate-shaped member and disposed opposite to the substrate 10. The cover 100 is connected to the substrate 10 through the fastening mechanism 400 such that the cover 100 is positioned parallel to the substrate 10 but spaced apart from each other, thereby forming certain distance between the cover 100 and the substrate 10.

In one embodiment, the fastening mechanism 400 may include a fastener 401. As shown in FIG. 4, the fastening mechanism 400 includes four fasteners 401, which are respectively located at four corners of the cover 100. At the four corners of the cover 100, there are provided through holes 101 for the fasteners 401, through which the fasteners 401 pass correspondingly.

At corresponding positions on the substrate 10, there are also provided with perforations, through which the fasteners 401 pass correspondingly. In this way, the fastener 401 passes through the through hole 101 of the cover 100 and the perforation of the substrate 10 so as to connect the cover 100 to the substrate 10.

The wiper support 200 is located between the cover 100 and the substrate 10, as shown in FIG. 3. In one embodiment, the wiper support 200 is also a generally plate-shaped member having a first surface 201 facing the cover 100 and a second surface 202 facing the substrate 10. The wiper 60 is fixed to the second surface 202 of the wiper support 200. A person skilled in the art should understand that, the wiper 60 may be fixed to the second surface 202 by any suitable means, for example, the wiper 60 may be directly adhered to the second surface 202.

As described above, the driving mechanism 40 is operatively coupled with the wiper support device 70. Accordingly, the movement of the driving mechanism 40 causes movement of the wiper support device 70, which in turn causes movement of the wiper 60 relative to the PCB 50.

Figure 5:
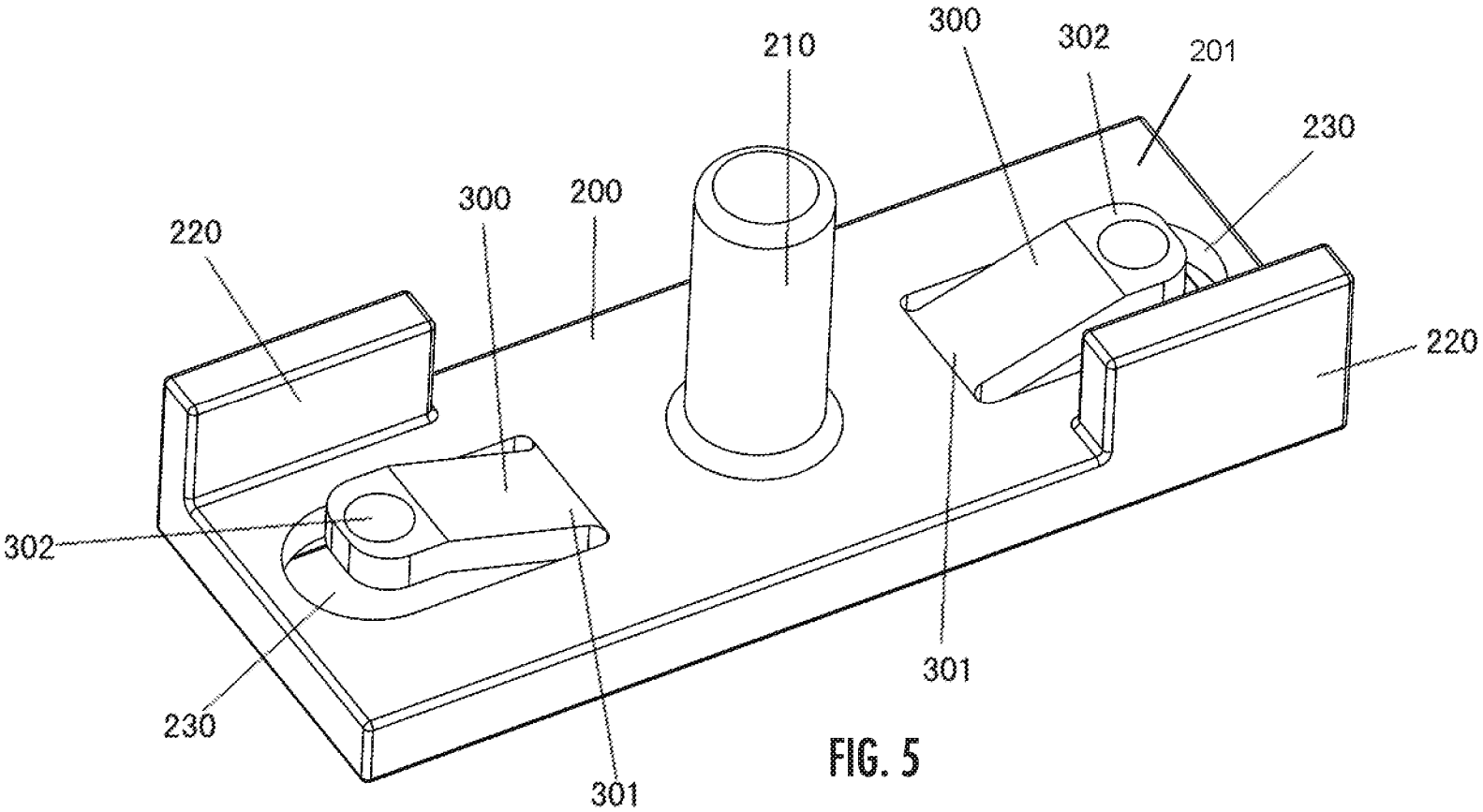
FIG. 5 is a perspective view of one embodiment of a wiper support of the wiper support device according to the present disclosure.
Figure 6:
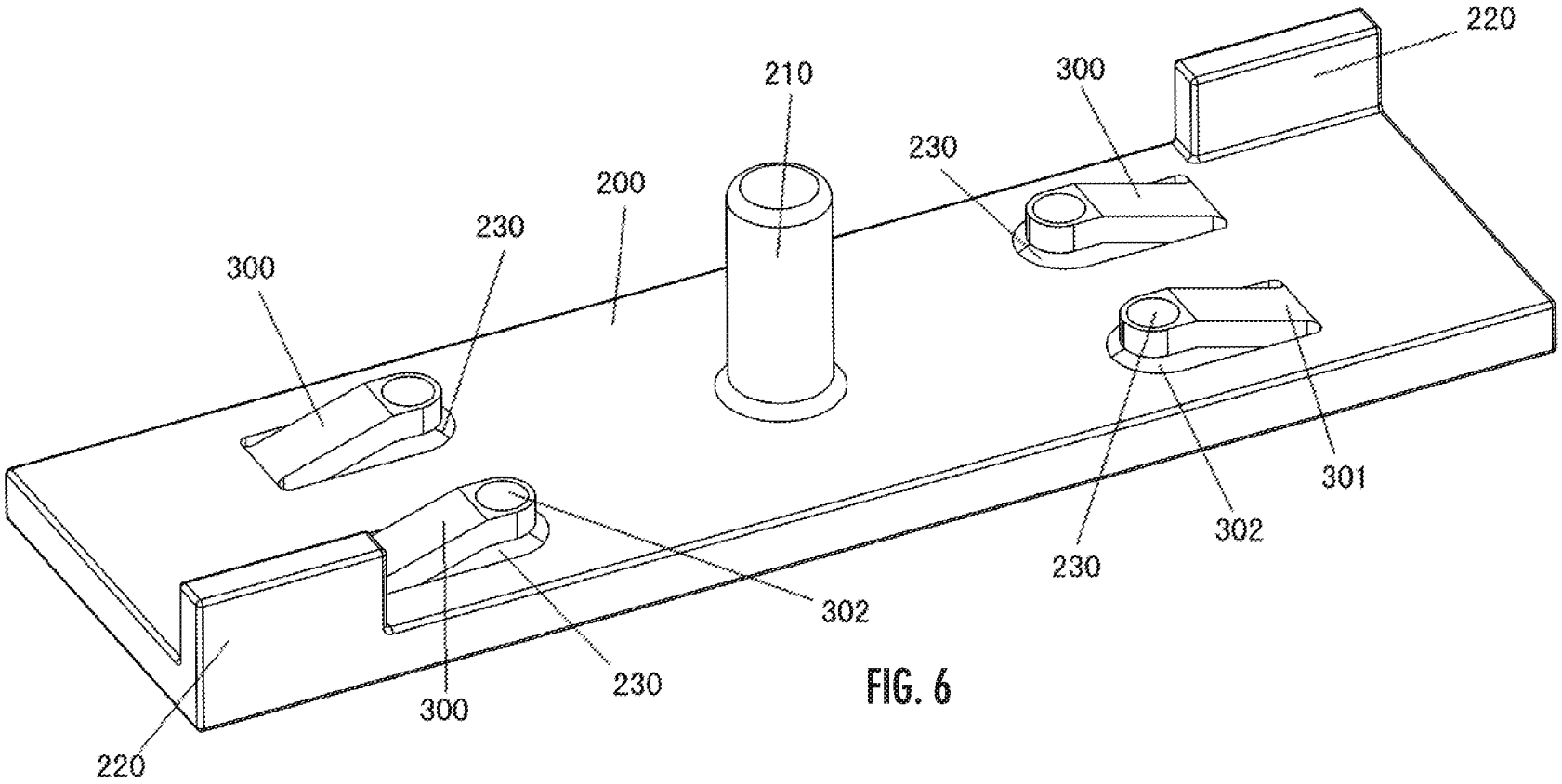
FIG. 6 is a perspective view of another embodiment of a wiper support of the wiper support device according to the present disclosure.

To this end, a coupling mechanism is provided on the wiper support device 70. Specifically, according to one embodiment, the coupling mechanism is in the form of a guide pin 210 (FIGS. 3, 5 and 6). As shown in FIGS. 3-6, the guide pin 210 is substantially centrally disposed on the wiper support 200. In one embodiment, the guide pin 210 is fixed to the wiper support 200. In another embodiment, the guide pin 210 is integrally formed with the wiper support 200.

As shown in FIGS. 5 and 6, the guide pin 210 which is disposed on the first surface 201 of the wiper support 200, extends from the first surface 201 toward the cover 100 (FIG. 3). The cover 100 (FIG. 3) is provided with a guide slot 102 (FIG. 4), through which the guide pin 210 passes such as to protrude from the guide slot 102 (FIG. 4). The guide slot 102 (FIG. 4) may use various types of shapes and sizes. The guide slot 102 (FIG. 4), which extends along a longitudinal direction, is shaped and sized to match a movement range of the guide pin 210, so that the guide pin 210 is movable within the guide slot 102 (FIG. 4). In addition, the guide slot 102 (FIG. 4) may be configured to define a movement range of the guide pin 210. For example, both ends of the guide slot 102 (FIG. 4) may serve as a stop to limit further movement of the guide pin 210.

The portion of the guide pin 210 protruding from the guide slot 102 is operatively coupled with the driving mechanism 40, and specifically, operatively coupled with the pull rod connector 43. As a result, the pull rod 41 of the driving mechanism 40 moves along a longitudinal direction, causing the pull rod connector 43 to move along a longitudinal direction and driving the guide pin 210 to move along a longitudinal direction within the guiding slot 102, so as to allow that the wiper support 200 moves along a longitudinal direction, and in turn to allow that the wiper 60 fixed on the second surface 202 of the wiper support 200 in the case of abutting against the PCB 50 moves relative to the PCB 50 along a longitudinal direction.

The resilient element 300 which is located between the cover 100 and the wiper support 200, extends from the first surface 201 of the wiper support 200 toward the cover 100 and eventually abuts the cover 100.

As shown in FIG. 3, the resilient element 300 extends obliquely toward the cover 100 relative to the first surface 201 of the wiper support 200. The distal end of the resilient element 300 abuts the cover 100, and is movable on a surface of the cover 100 facing the wiper support 200.

In one embodiment, the resilient element 300 may be in the form of, for example, a resilient finger, extending from the first surface 201 of the wiper support 200 toward the cover 100. One end of the resilient finger is a fixed end 301, which is fixed to the first surface 201 of the wiper support 200, or which is formed integrally with the wiper support 200. The other end of the resilient finger is a free end 302, which abuts the cover 100 and is movable with respect to the cover 100 on a surface of the cover 100 facing the wiper support 200.

FIG. 5 shows one embodiment of the wiper support 200 and the resilient element 300, and FIG. 6 shows another embodiment of the wiper support 200 and the resilient element 300. In the embodiments shown in FIGS. 5 and 6, the fixed end 301 of the resilient member 300 is formed integrally with the wiper support 200. The wiper support 200 is formed with a cutout 230, at one end of which the fixed end 301 of the resilient element 300 is located. Viewed along a direction perpendicular to the first surface 201, the resilient element 300 is located within the cutout 230, so that the resilient element 300 when compressed may be deformed towards the cutout 230 so as to enter the cutout 230. The advantage presented by such configuration lies in that it is possible to further save a space required for accommodating the resilient element 300 to perform resilient deformation, such that the structure of the wiper support device 70 is more compact.

In addition, FIGS. 5 and 6 respectively show different extension manners of the resilient element 300. In FIG. 5, the resilient element 300 extends from the first surface 201 of the wiper support 200 toward the cover 100 and away from the guide pin 210, whereas in FIG. 6, the resilient element 300 extends from the first surface 201 of the wiper support 200 towards the cover 100 and toward the guide pin 210. A person skilled in the art may understand that, the resilient element 300 may also use any other suitable extension manner.

The free end 302 of the resilient element 300 may present multiple forms, for example the forms as shown in FIGS. 5 and 6. In one embodiment, the free end 302 has a flat contact surface, which always remains in contact with the surface of the cover 100 facing the wiper support 200. In the case that there is a flat contact surface, a face contact is formed between the resilient element 300 and the cover 100. In another embodiment, the free end 302 has a projection 303 (FIG. 3), which always remains in contact with a surface of the cover 100 facing the wiper support 200. In the case that there is a projection 303 (see FIG. 3), point contact is formed between the resilient member 300 and the cover 100. A person skilled in the art should understand that, the free end 302 of the resilient element 300 may also use any other suitable form.

As described above, the resilient element 300, which is disposed between the cover 100 and the wiper support 200, extends from the wiper support 200 to abut the cover 100. According to the embodiment of the present disclosure, the resilient element 300 is configured to be compressed between the cover 100 and the wiper support 200, and always remain compressed during the entire operation of the phase shifter 1.

Since the resilient element 300 is compressed between the cover 100 and the wiper support 200, the resilient element 300 applies a pressing force to the wiper support 200 so as to bias the wiper support 200 toward the substrate 10. As described above, the wiper 60 is fixed on the second surface 202 of the wiper support 200, the PCB 50 is fixed on the substrate 10, and the wiper 60 abuts against the PCB 50. Thus, the resilient element 300 applies pressure to the wiper support 200 so that, in turn, pressure is exerted between the wiper 60 and the PCB 50.

Since the resilient element 300 extends between the cover 100 and the wiper support 200, a distance between the cover 100 and the wiper support 200 determines a degree at which the resilient element 300 is compressed. In this case, since the wiper 60 is fixed on the second surface 202 of the wiper support 200, the PCB 50 is fixed on the substrate 10, and the wiper 60 abuts against the PCB 50, a distance between the cover 100 and the wiper support 200 actually determines a distance between the cover 100 and the substrate 10. That is, when the cover 100 is fixed to the substrate 10 by the fastening mechanism 400, the distance between the cover 100 and the substrate 10 is associated with a degree at which the resilient element 300 is compressed.

In operation of the phase shifter 1, the wiper 60 is required to press against the PCB 50 with a suitable pressure, so as to maintain a favorable contact between the wiper 60 and the PCB 50 during movement of the wiper 60 relative to the PCB 50. In the meantime, the pressure between the wiper 60 and the PCB 50 cannot be too high. Otherwise, there may be an excessive friction force between the wiper 60 and the PCB 50, which results in difficulty for the wiper 60 to move relative to the PCB 50.

Therefore, it is desirable that the pressure between the wiper 60 and the PCB 50 is adjustable so as to provide a proper pressure according to actual needs. It can be known from the above descriptions that, the degree at which the resilient element 300 is compressed is associated with the pressure between the wiper 60 and the PCB 50, and moreover, the distance between the cover 100 and the substrate 10 is associated with the degree at which the resilient element 300 is compressed. Thus, the pressure between the wiper 60 and the PCB 50 may be adjusted by adjusting the distance between the cover 100 and the substrate 10.

According to one embodiment of the present disclosure, the distance between the cover 100 and the substrate 10 may be adjusted by selecting a fastening mechanism 400 of a different size. That is, the distance between the cover 100 and the substrate 10 is determined on the basis of the pressure required between the wiper 60 and the PCB 50, and a suitable fastening mechanism 400 is selected according to the distance between the cover 100 and the substrate 10.

According to another embodiment of the present disclosure, the fastening mechanism 400 may be provided with an adjusting means 410 (FIG. 4), which is configured to adjust a distance between the cover 100 and the substrate 10. The adjusting means 410 may use any suitable configuration, for example, an adjusting screw, an indexing adjusting means, and the like may be used.

In operation of the phase shifter 1, the pressure between the wiper 60 and the PCB 50 is desirably uniform, thereby improving the operation accuracy of the phase shifter 1.

As described above, the wiper 60 is fixed on the second surface 202 of the wiper support 200, the PCB 50 is fixed on the substrate 10, and the wiper 60 abuts against the PCB 50. According to one embodiment of the present disclosure, the second surface 202 of the wiper supporter 200 is configured such that its surface area is greater than the surface area of the wiper 60 so that the wiper 60 can be completely covered by the second surface 202 when the wiper 60 is completely fixed to the second surface 202. In this case, the pressing force on the wiper support 200 produced due to the compression of the resilient element 300 can be uniformly applied to the entire wiper 60 so that the pressure between the wiper 60 and the PCB 50 is uniform.

According to one embodiment of the present disclosure, the cover 100, the wiper support 200 and the substrate 10 are arranged parallel to one another, and always remain arranged in parallel during an operation process of the phase shifter 1.

The cover 100 and the substrate 10 are both made of a rigid material. By the connection of the fastening mechanism 400, the distance between the cover 100 and the substrate 10 always remains uniform so that the cover 100 and the substrate 10 remain arranged in parallel.

As described above, the guide pin 210 is disposed substantially centrally on the wiper support 200. In order to maintain a uniform pressing force produced by the resilient element 300 on the entire wiper support 200, there may be provided with a plurality of resilient elements 300, which may be resilient elements of the same configuration. As shown in FIGS. 5 and 6, a plurality of resilient elements 300 are arranged on the wiper support 200 in a regular manner, preferably arranged symmetrically with respect to the guide pins 210. For example, as shown in FIG. 5, according to one embodiment of the wiper support device 70, there are provided with two resilient elements 300, which are arranged on both sides of the guide pin 210 and symmetrically arranged with respect to the center of the guide pin 210. For example, as shown in FIG. 6, according to one embodiment of the wiper support device 70, there are provided with four resilient elements 300, which are symmetrically arranged around the center of the guide pin 210. A person skilled in the art may understand that, the amount and arrangement manner of the resilient elements 300 are not limited thereto, and various other suitable amounts and arrangement manners are also possible according to actual needs in application.

In the case that the cover 100, the wiper support 200 and the substrate 10 are arranged parallel to one another, with the aid of the symmetrical arrangement of the plurality of resilient elements 300, the pressing force produced by compression of the resilient elements 300 on the wiper support 200 can be uniformly exerted on the entire wiper 60, in turn causing a uniform pressure between the wiper 60 and the PCB 50, during an operation process of the phase shifter.

The phase shifter 1 may have a plurality of primary phase shifters 20 and/or secondary phase shifters 30. In this case, it may be necessary to ensure that the pressure between all the wipers 60 and the PCB 50 is uniform. To this end, the cover 100 may be configured for a plurality of wiper support devices 70, preferably for all the wiper support devices 70. For example, as shown in FIGS. 1 and 2, one cover 100 is provided. In other words, a plurality of wiper support devices 70 share one cover 100, thus ensuring that in all the wiper support devices 70, the distance between the cover 100 and the substrate 10 is uniform and the same, maintaining that the cover 100 and the substrate 10 are arranged in parallel.

In this case, the resilient element 300 in each of the wiper support devices 70 may use the same configuration, so that during operation of the phase shifter, the pressure produced by compression of the resilient elements 300 on the wiper support 200 can be uniformly exerted on the entire wiper 60, in turn causing a uniform pressure between all the wipers 60 and the PCB 50.

Those of skill in this art will appreciate that the resilient element may take other forms. For example, when in the form of a resilient finger as described above, the resilient member may be disposed at a different oblique angle relative to the wiper support 200, which may influence the pressure experience by the wiper. The resilient finger may be tapered in width or depth along its length to produce a desired force when deflected. The locations and/or angular dispositions of the resilient fingers may vary from that shown herein. Moreover, the resilient member may take a sinuous or serpentine form, with multiple bends and angles (much like a spring), and provide pressure due to compression thereof rather than bending. The resilient members may also comprise multiple layers to impact the pressure force (for example, a damping material may be included as the contact surface to assist with uniformity of pressure). Other variations may also be employed.

In one embodiment of the wiper support device 70 according to the present disclosure, the wiper support 200 may be provided with a positioning member 220, and correspondingly, the cover 100 may be provided with a positioning slot 103. As shown in FIGS. 2 and 4, the positioning member 220 may be disposed on an edge of the wiper support 200, protruding from the first surface 201 of the wiper support 200 toward the cover 100. When the wiper support device 70 is assembled, the positioning member 220 extends into the positioning slot 103 to facilitate the positioning of the wiper support 200 relative to the cover 100.

The foregoing is illustrative of the present disclosure and is not to be construed as limiting thereof. Although exemplary embodiments of this invention have been described, those skilled in the art should readily appreciate that many variations and modifications are possible in the exemplary embodiments without materially departing from the novel teachings and advantages of this invention. Accordingly, all such variations and modifications are intended to be included within the scope of this invention as defined in the claims. The invention is defined by the following claims, with equivalents of the claims to be included therein.

The invention claimed is:

1. A wiper support device for a phase shifter, the phase shifter including a substrate, the wiper support device comprising:

a cover provided opposite to the substrate;

a wiper support located between the cover and the substrate, the wiper support having a first surface facing the cover and a second surface facing the substrate, the second surface being fixed with a wiper;

a resilient element extending from the first surface of the wiper support toward the cover and abutting against the cover; and a fastening mechanism connecting the cover to the substrate, wherein the resilient element is compressed between the cover and the wiper support.

2. The wiper support device according to claim 1, wherein the resilient element extends obliquely towards the cover with respect to the first surface of the wiper support and is movable relative to the cover on a surface of the cover.

3. The wiper support device according to claim 1, wherein the wiper support is provided with a cutout, the resilient element is located within the cutout when viewed along a direction perpendicular to the first surface such that the resilient element, when compressed, is deformable towards the cutout so as to enter into the cutout.

4. The wiper support device according to claim 1, wherein the wiper support is provided with a guide pin, and the cover is provided with a guide slot, the guide pin passing through the guide slot and being movable within the guide slot.

5. The wiper support device according to claim 1, wherein the resilient element is a resilient finger extending from the first surface of the wiper support toward the cover, one end of the resilient finger is fixed to the first surface of the wiper support, and the other end of the resilient finger is a free end abutting against the cover and movable on a surface of the cover relative to the cover.

6. The wiper support device according to claim 5, wherein the free end has a flat contact surface which remains in contact with the surface of the cover facing the wiper support, so as to form a face contact between the resilient element and the cover.

7. The wiper support device according to claim 5, wherein the free end has a projection which remains in contact with the surface of the cover facing the wiper support, so as to form a point contact between the resilient element and the cover.

8. The wiper support device according to claim 1, wherein the wiper support is provided with a guide pin, and the cover is provided with a guide slot, the guide pin passing through the guide slot and being movable within the guide slot.

9. The wiper support device according to claim 8, wherein the guide slot has an end that serves as a stop to limit a movement of the guide pin.

10. The wiper support device according to claim 8, wherein the guide pin is centrally disposed on the wiper support.

11. The wiper support device according to claim 1, wherein the cover is connected to the substrate via the fastening mechanism such that a distance between the cover and the substrate is associated with an amount in which the resilient element is compressed.

12. The wiper support device according to claim 1, wherein the fastening mechanism comprises an adjusting means, which is configured to adjust a distance between the cover and the substrate.

13. The wiper support device according to claim 1, wherein a PCB is fixed on the substrate, and the wiper abuts against the PCB, wherein the wiper is completely covered by the second surface of the wiper support.

14. The wiper support device according to claim 1, wherein the cover, the wiper support and the substrate are arranged parallel to each other and remain arranged in parallel during operation of the phase shifter.

15. The wiper support device according to claim 1, wherein the wiper support device comprises a plurality of resilient elements arranged in a regular manner on the wiper support.

16. The wiper support device according to claim 15, wherein the plurality of resilient elements have the same configuration.

17. The wiper support device according to claim 15, wherein the plurality of resilient elements are arranged symmetrically around a center of a guide pin.

18. The wiper support device according to claim 1, wherein the wiper support is provided with a positioning member, and the cover is provided with a positioning slot, and wherein when the wiper support device is assembled, the positioning member extends into the positioning slot.

19. A phase shifter, the phase shifter comprising:

a driving mechanism; and the wiper support device according to claim 1, wherein the driving mechanism is configured to drive the wiper support.

20. The phase shifter according to claim 19, wherein the driving mechanism includes a pull rod and a pull rod connector fixedly connected to the pull rod, the pull rod connector being configured to drive the wiper support.

* * * * *